United States Patent [19]

Yamada et al.

[11] 4,096,531

[45] Jun. 20, 1978

[54] DEFLECTION YOKE

[75] Inventors: Yukio Yamada; Yoji Ishikawa, both of Yokohama; Koichi Sakai, Tokyo, all of Japan

[73] Assignee: Sony Corporation, Tokyo, Japan

[21] Appl. No.: 800,576

[22] Filed: May 25, 1977

[30] Foreign Application Priority Data

Jun. 1, 1976 Japan ..... 51-62893

[51] Int. Cl.[2] ..... H01C 5/02

[52] U.S. Cl. ..... 358/248; 335/213

[58] Field of Search ..... 358/248; 335/213

[56] References Cited

U.S. PATENT DOCUMENTS

| | | | |
|---|---|---|---|
| 3,671,894 | 6/1972 | Sawada | 358/248 |
| 3,764,740 | 10/1973 | Deal | 358/248 |

*Primary Examiner*—Howard W. Britton

*Attorney, Agent, or Firm*—Lewis H. Eslinger; Alvin Sinderbrand

[57] ABSTRACT

A deflection yoke for use with a cathode ray tube includes a pair of half-cut separators joined together to form a complete separator, a pair of saddle wound horizontal deflection coils mounted on the separator halves and a pair of toroidal wound vertical deflection coils wound about half-cut coils and assembled about the separator. The plane of separation between the saddle wound horizontal deflection coils, the half-cut separators and the toroidal wound vertical deflection coil is the same plane. Provision is also made for proper orientation of the saddle wound horizontal deflection coils in each half-cut separator and for location of the toroidal wound vertical deflection coil about the separator.

9 Claims, 14 Drawing Figures

FIG. 5
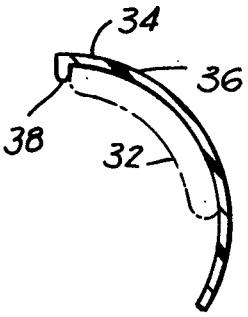
FIG. 6
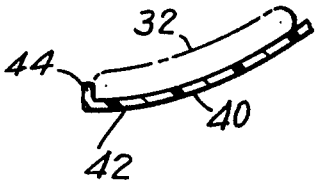
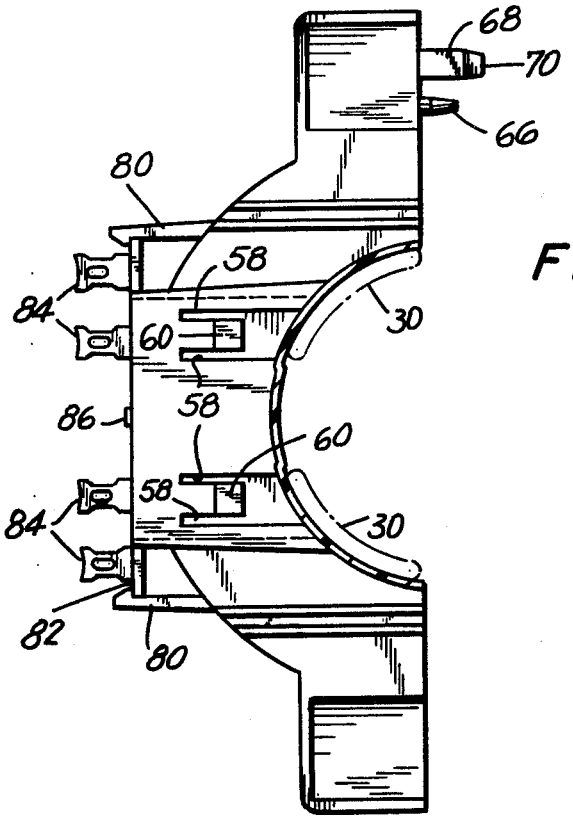
FIG. 7

DEFLECTION YOKE

BACKGROUND OF THE INVENTION

1. Field of the Invention

The present invention relates to a deflection yoke used with a cathode ray tube and more particularly is directed to such a yoke having saddle wound horizontal deflection coils mounted on a separator and toroidal wound vertical deflection coils wound about a core positioned about the separator.

2. Description of the Prior Art

FIG. 1 in the accompanying drawing illustrates a deflection yoke of the prior art. Such yokes include a separator 1 formed by two half-cut separators 2, 2 and a pair of saddle wound horizontal deflection coils 3, 3. The coils 3, 3 are received in the gradually widening surface 4. A pair of toroidal wound deflection coils 5, 5 wound about half-cut core pieces 6, 6 are assembled about separator 1.

In the assembly of such prior art deflection coils the horizontal coils are installed against surface 4 of separator 1 with the plane dividing coils 3, 3 being perpendicular to the plane passing through the joining of separator halves 2, 2. The positional relationship of the horizontal deflection coils 3, 3 is maintained by projecting segment 7 in the center of surface 4 of each separator half. After this assembly, a pair of vertical deflection coils 5 toroidally wound about half core segments 6 are mounted on the rear side of separator 1. The dividing plane of coils 5, 5 and half core segments 6, 6 and the plane through the joining of separator halves 2, 2 are perpendicular.

In assembling such a prior art deflection yoke the separator halves, the pair of horizontal deflection coils and the vertical deflection coils wound about the half core segments must all be supported at the front and rear during assembly. This makes assembly of such deflection yokes difficult as the coils, separator halves and wound cores must all be handled at the same time. This assembly technique makes it difficult to properly locate the saddle wound horizontal deflection coils with respect to the separator halves because these coils extend over both halves of the separator.

In addition this assembly technique makes it difficult to examine the separator from a quality control viewpoint and does not provide adequate protection of the coils during the assembly process as the saddle wound cores are unsupported during part of the assembly process.

OBJECTS AND SUMMARY OF THE INVENTION

Accordingly, it is an object of the present invention to provide an improved deflection yoke in which the above-described disadvantages of assembly are avoided.

More specifically, it is an object of the present invention to provide a deflection yoke in which saddle wound horizontal deflection coils may be separately and fully assembled in separator halves before joining the two separator halves together.

A still further object of the present invention is to provide a deflection yoke in which the horizontal saddle wound coil may be fully assembled on a separator half and a toroidal wound vertical deflection coil may be properly positioned with respect to the separator half before the two separator halves are assembled together.

In accordance with an aspect of this invention, a deflection yoke is provided in which a saddle wound horizontal deflection yoke is retained completely within one half of a separator. The plane of separation between the pair of horizontal deflection coils being coincident with the plane of separation of the two half separators. In addition, toroidal wound vertical deflection coils are wound about half core segments with each half core segment being properly oriented and positioned with respect to its respective separator half prior to final assembly. Thus, the assembly process for deflection yokes is greatly simplified providing for ease of assembly as well as ease of inspection and also providing physical support for the saddle wound deflection coils to preclude undesired distortion of the windings.

The above, and other objects, features and advantages of this invention, will be apparent in the following detailed description of an illustrative embodiment which is to be read in connection with the accompanying drawings.

BRIEF DESCRIPTION OF THE DRAWINGS

FIG. 5 is a cross-sectional view taken on line 5—5 of FIG. 2;

FIG. 6 is a cross-sectional view taken on line 6—6 of FIG. 2;

FIG. 7 is a cross-sectional view taken on line 7—7 of FIG. 4;

DETAILED DESCRIPTION OF A PREFERRED EMBODIMENT

Figure 2:
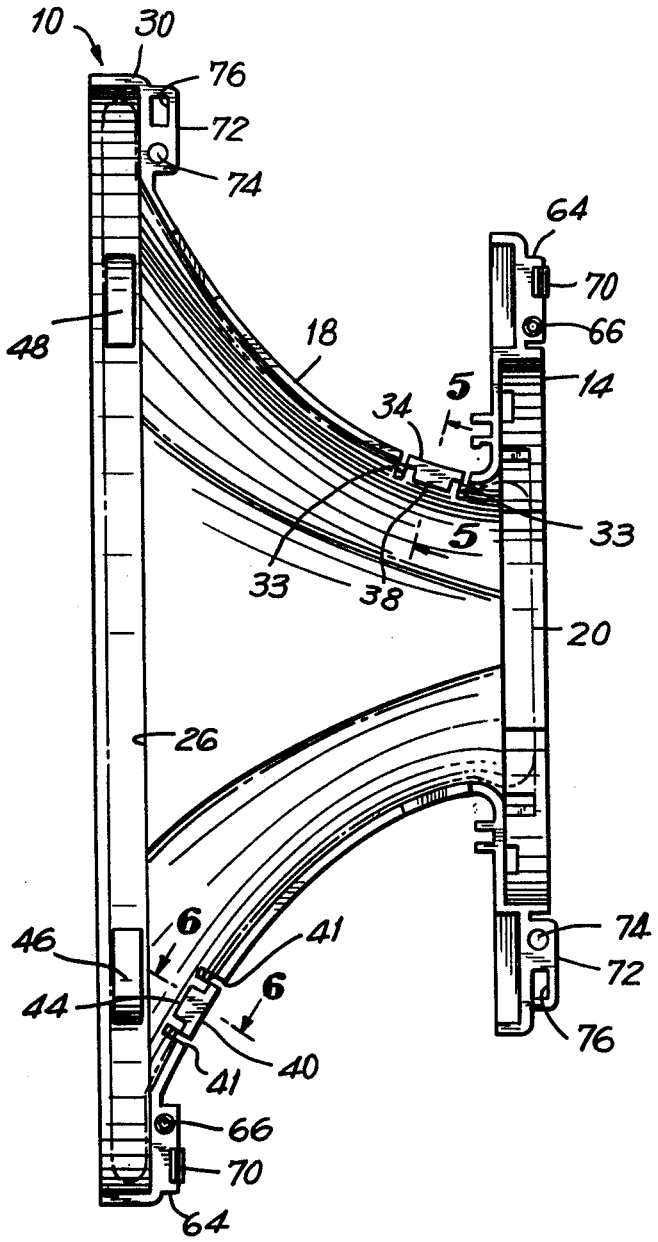
FIG. 2 is an elevational view from the joining surface of a separator half which forms a part of the deflection yoke of the present invention.
Figure 3:
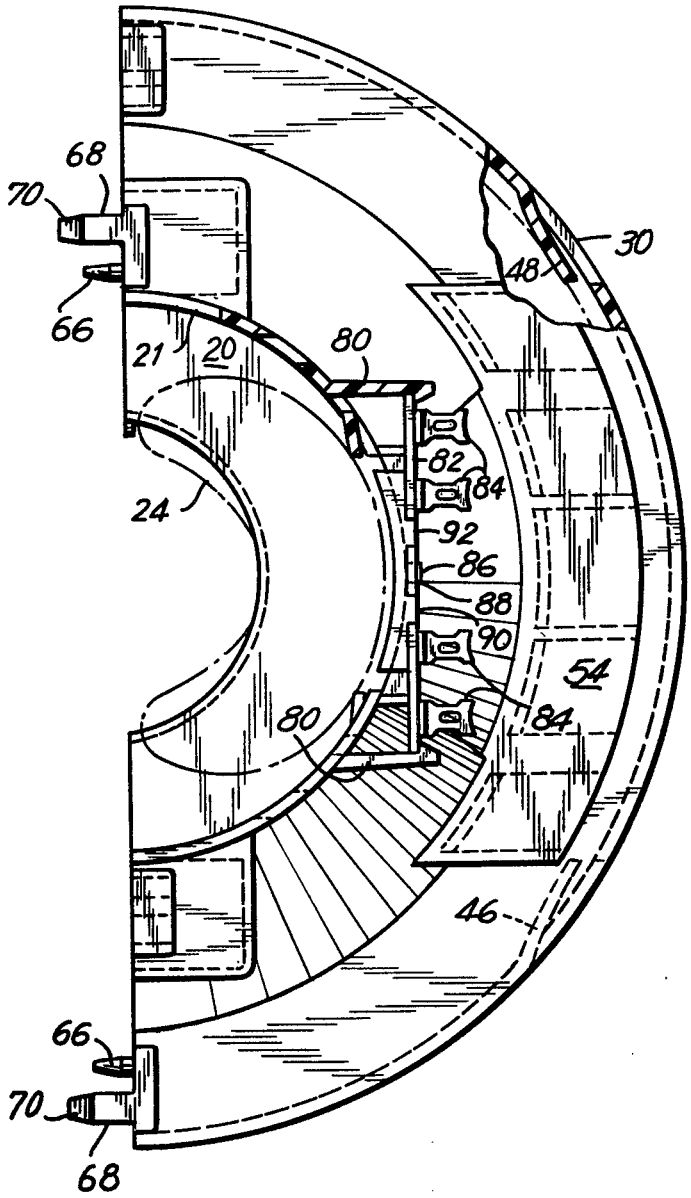
FIG. 3 is a partially broken plan view of the separator half shown in FIG. 2.
Figure 4:
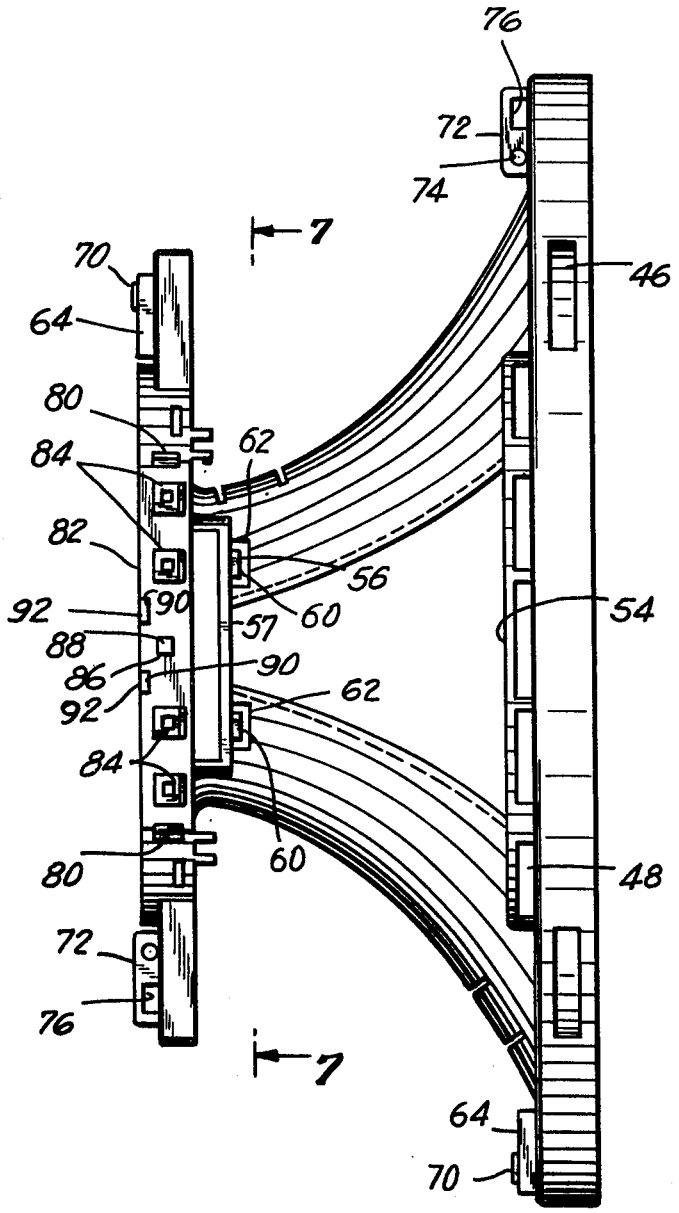
FIG. 4 is an elevational view of a separator half of the present invention from the opposite side as that shown in FIG. 2.

Referring to the drawings in detail, and initially to FIGS. 2–4 thereof, there is shown one-half of a separator housing 10 which is employed in the deflection yoke of the present assembly by being assembled into a complete separator unit 12 with an identical separator half 10. Thus, the completed separator 12 is assembled from a pair of separator halves 10, 10 with each of the separator halves having the same structure. In the following, description only one of the separator halves will be explained in detail.

Each separator half 10 includes a rear portion 14 which is positioned snugly about the neck portion of a cathode ray tube (not shown), a front portion 16 which is positioned about the core portion of the cathode ray tube and a curved portion 18 between the rear portion 14 and front portion 16. The curved portion 18 has a gradually increasing width extending from the rear to the front and is dimensioned to closely follow the curve along the cathode ray tube on which the deflection yoke of the present invention is installed. The curved portion 18 is the portion of the yoke upon which the horizontal and vertical deflection coils are mounted.

Figure 8:
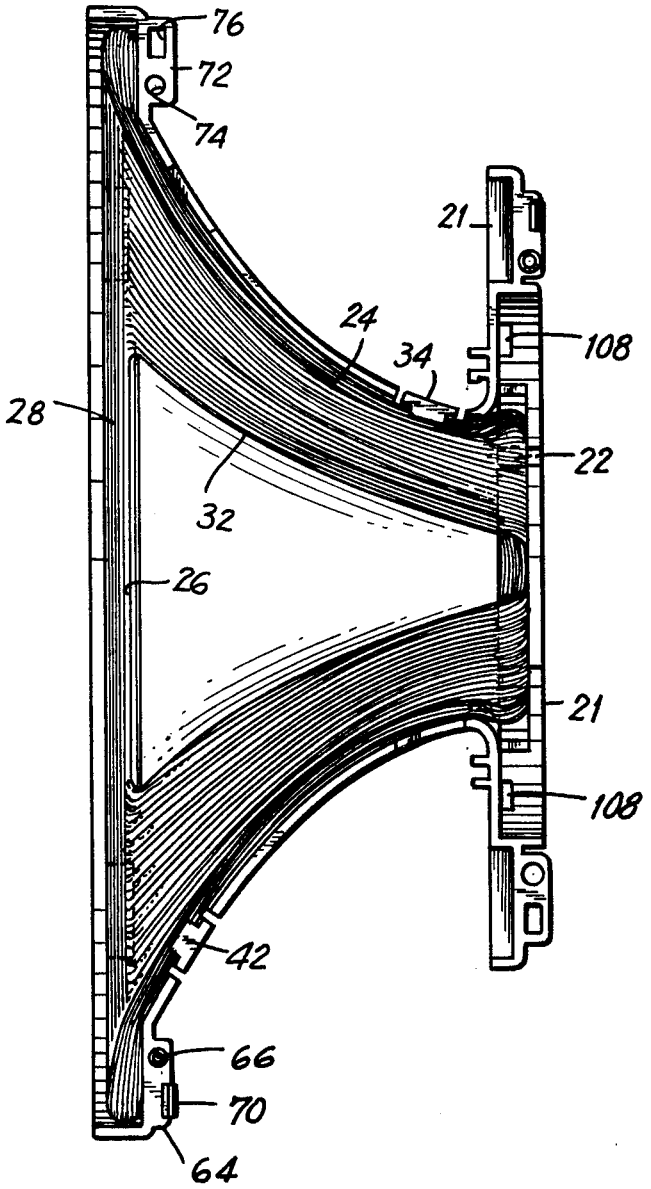
FIG. 8 is an elevational view similar to FIG. 2 showing a separator half with a saddle wound horizontal deflection coil installed therein.

Rear portion 14 of the separator half 10 includes a flat surface 20 facing rearwardly which serves as a bearing surface for a bend portion 22 of a saddle wound horizontal deflection coil 24 (see FIG. 8 as well). A flange segment 21 extends outwardly from the periphery of surface 20. Front portion 16 also includes a flat bearing surface 26 formed as a frontwardly facing flange segment which acts as a bearing surface for the top portion 28 of the saddle wound horizontal deflection coil. The flat bearing surfaces 26 and 20 are formed substantially parallel to each other. Front portion 16 also includes a flange segment 30 extending outwardly from the periphery of bearing surface 26.

As seen in FIG. 8, saddle wound horizontal deflection coil 24 is installed with its opposite ends against the bearing surfaces 20 and 26 and with the mid-windings of the coils 32 pressed against the inner surface of curved portion 18 of the separator half 10. To retain the coil in the proper position and orientation within the separator half there are provided projection pieces to hold the saddle wound horizontal deflection coil within the separator half. One such projection piece 34 (see FIGS. 2 and 5) is formed in the separator half 10 toward the rear portion of curved portion 18 at the mating surface of the separator half. Projection piece 34 is formed by slots 33 part way into portion 18 to define a tab portion 36 integral with curved portion 18 of the separator half. A radially directed flange member 38 extends from the end of tab 36 and acts as an abutment to retain and position the horizontal deflection coil 24. Tab portion 36 provides a resilient retention member. In like manner, a projection tab 40 is provided (see FIGS. 2 and 6) on the opposed mating surface of separator half 10 toward the front portion which includes slots 41 defining a tab projection 42 and extending flange 44.

Each separator half 10 is also provided with raised spring tab members 46 and 48 formed integral with flange 30 by a cutout around three sides of the tab. Tabs 46 and 48 are also formed to project inwardly for resilient abutting contact with the top portion 28 of the horizontal deflection coil 24 when the coil is positioned within the separator half.

Figure 9:
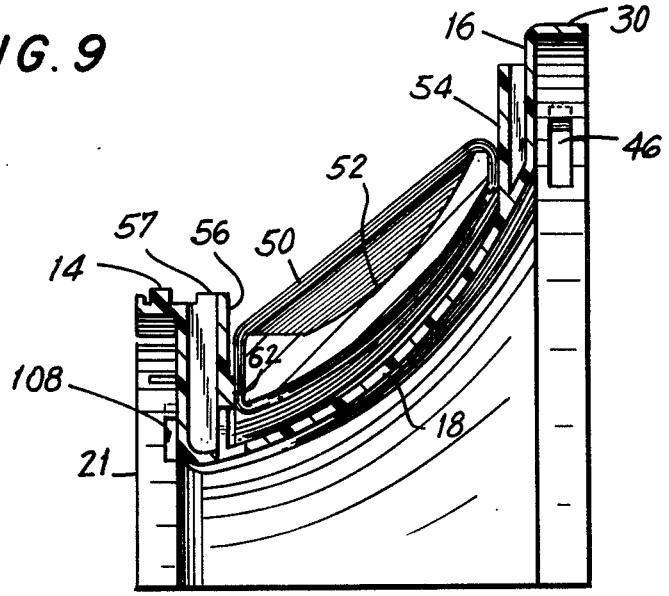
FIG. 9 is a cross-sectional view showing a separator half with a toroidal wound deflection coil mounted thereon.
Figure 14:
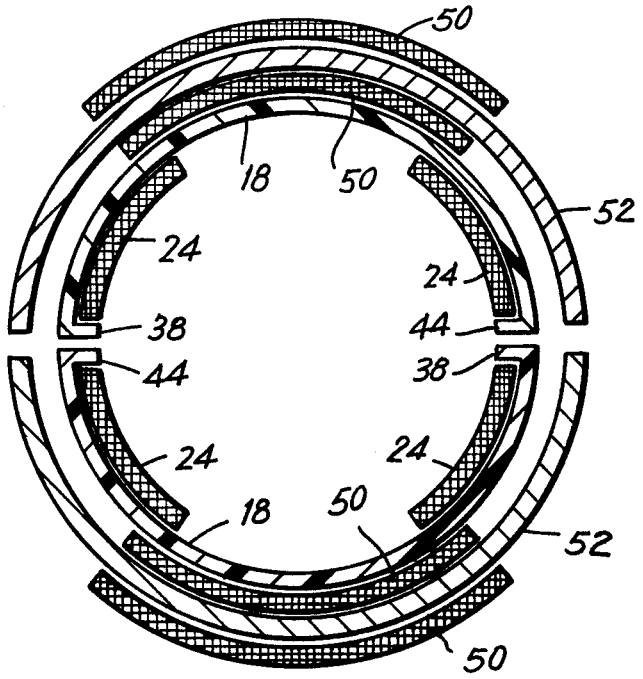
FIG. 14 is a cross-sectional view of the deflection yoke of the present invention showing the relationship between the horizontal and vertical deflection coils and the separator halves.

A toroidal wound vertical deflection coil is positioned about each separator half 10 (see FIG. 9). As with the separator halves 10, a pair of vertical deflection coils are utilized which are identical so that a description of one such coil will suffice to describe both. Thus each toroidal wound coil 50 is manufactured by winding the coil on a core half 52. Each core half 52 is dimensioned to closely fit about a separator half on the exterior of curved portion 18 between rear portion 14 and front portion 16.

To accommodate the toroidal wound vertical deflection coils, separator half 10 includes a raised flat bearing surface 54 (see FIG. 4 as well) on the rearwardly facing surface of front portion 16. A pair of spring projections 56 are formed on separator half 10 on a raised surface 57 the front facing side of rear portion 14 to resiliently urge the toroidal wound vertical deflection coil 50 against bearing surface 54. Spring projections 56 are formed by slots 58 defining a tab 60 (see FIG. 7) and include extending projections 62 at the end of each tab 60 to contact the toroidal wound deflection coil. The tab and slots provide a resiliency which give a spring-like action to maintain the coil in its assembled state on the separator half 10 and also positions the vertical direction deflection coil in its proper orientation.

In order to provide easy assembly of the two separator halves 10, 10 each separator at its mating abutting edge is provided with integrally formed adjoining members to securely interlock the separator halves in a predetermined positional relationship. To this end separator half 10 is provided with integrally molded locking members disposed for mating interengagement when separator halves 10, 10 are placed together. Thus adjacent the mating surface of a separator half 10 on one side thereof is formed a raised boss 64. Extending at right angles to the plane encompassing the mating surface of the separator half is a pin or locating dowel 66 and a projecting member 68 having a rectangular cross-sectional configuration and an enlarged end segment or lip 70. On the opposite side of each separator half 10 at a corresponding location is formed a boss 72 within which is formed a receiving bore 74 and a rectangular shaped opening 76. When mating separator halves 10, 10 are assembled together dowel or pin 66 locates and properly orients the positional relationship of the two mating separator halves as the dowel is inserted in receiving bore 74 and rectangular projection 68 fits within rectangular opening 76 with the enlarged end 70 providing an interlock with the opposite surface of boss 72 to securely lock the mating separator halves 10 together.

Figure 13:
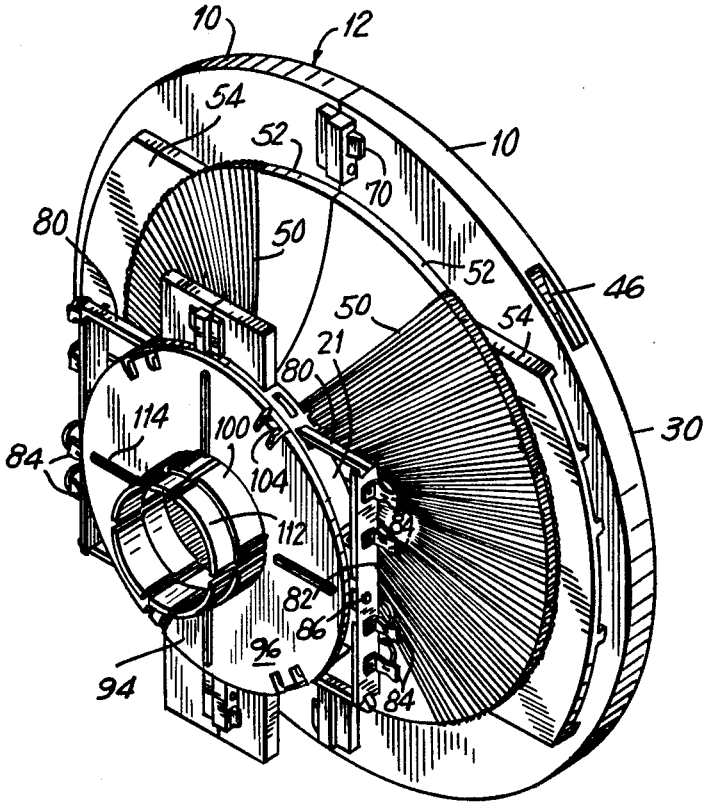
FIG. 13 is a rear perspective view of the deflection yoke of the present invention.

In like manner a similar coupling assembly is provided molded integrally with the front portion of each separator half 10 so that, as seen in FIG. 13, the separator halves 10 are securely interlocked at two places adjacent the front end and two places adjacent the rear end of the separator halves.

On the rear portion 14 of each separator half a terminal assembly mount 78 is provided (see FIG. 3) which includes arms 80 extending from rear portion 14 to support a terminal plate 82 on which are mounted terminals 84 to which the respective ends of horizontal deflection coil 24 and vertical deflection coil 50 are connected. A centrally positioned projection 86 is also provided extending from the separator half 10 with projection 86 fitting through a hole 88 at the mid-point of terminal plate 82 to support the terminal plate. In addition slots 90 are also formed on terminal plate 82 within which fit projections 92 extending from rear portion 14 of separator half 10. Thus the terminal plate 82 is properly located and positioned securely on separator half 10.

To assemble the deflection yoke of the present invention, each half separator is assembled as a complete unit prior to the interconnection of two separator halves to form a completed deflection yoke. Thus as a first step a horizontal deflection coil 24 is installed in its proper position within a separator half 10 properly positioned and supported by the projection pieces 34 and 40 as well as by the spring projections 46, 48. After the horizontal deflection coil 24 is properly supported and oriented in its correct position the toroidal wound vertical deflection coil 50 wound about the core half 52 is mounted in its proper position on separator half 10. The connecting leads from each of the horizontal and vertical deflection coils are connected to the proper terminals on terminal plate 82 and the unit may be inspected for quality control purposes to insure proper assembly.

A pair of identically assembled separator halves of the deflection yoke are then assembled together into a single body by proper engagement of the interconnecting assembly members. After the assembly is completed a band (not shown) is wound around the exterior of vertical defection coils 50, 50 and the assembly is completed by installation of a back plate 94.

Figure 10:
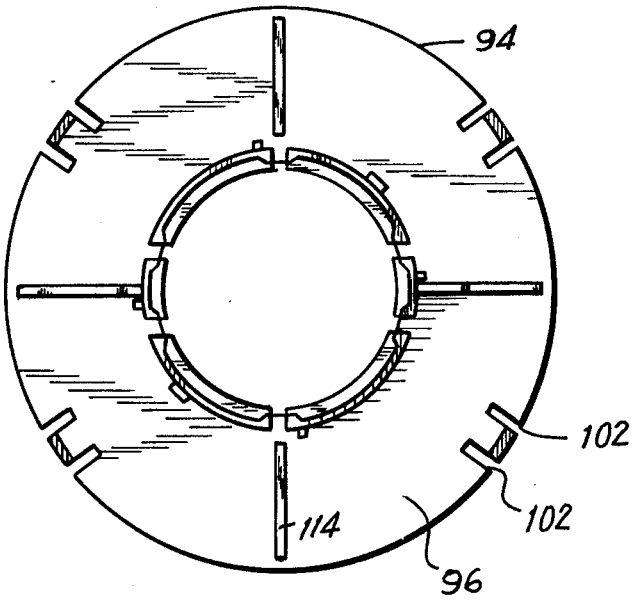
FIG. 10 is a plan view of a back plate which forms a part of the deflection yoke of the present invention.
Figure 11:
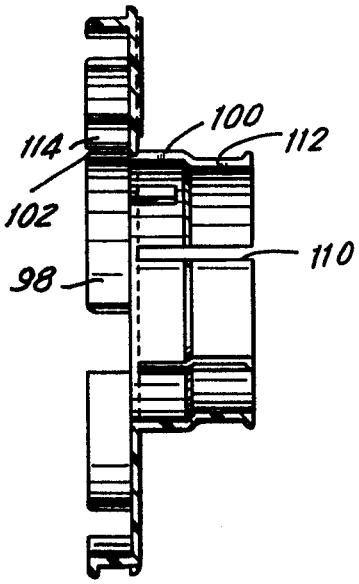
FIG. 11 is a cross-sectional view of the back plate of FIG. 10.
Figure 12:
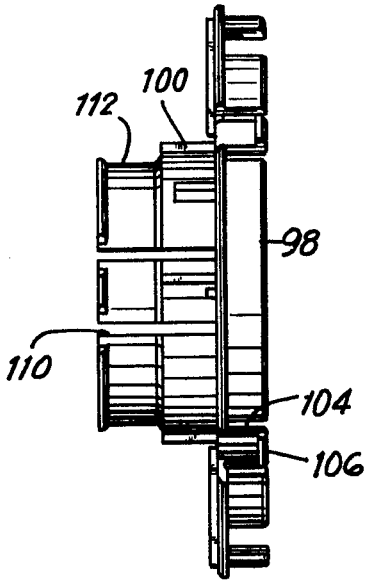
FIG. 12 is a side view of the back plate of FIG. 10.

Back plate 94 (see FIGS. 10–12) includes a disc-like segment 96 having a peripheral flange 98 extending from one side and a substantially integral cylindrical portion 100 extending from the other side of disc 96. In each quadrant of back plate 94 spaced slots 102 are formed through the flange 98 and part way into the disc member 96 to form an extending prong member 104 formed with an enlarged end 106 adapted to fit and lock in openings 108 formed in flange 21 of rear portion 14. Thus back plate 94 is secured to the assembled separator 12.

Cylindrical segment 100 which receives the end of a cathode tube on which the deflection yoke is installed is provided with spaced slots 110 and a necked down portion 112. When the deflection yoke of the present invention is installed over a cathode ray tube a securing band (not shown) is wrapped about the back plate around the necked down portion 112 and tightened. Slots 110 allow for inward contraction of the back plate after the band has been secured thereby insuring secure placement of the deflection yoke around a cathode ray tube. Ribs 114 formed on disc portion 96 provide additional strength to the disc portion.

Figure 1:
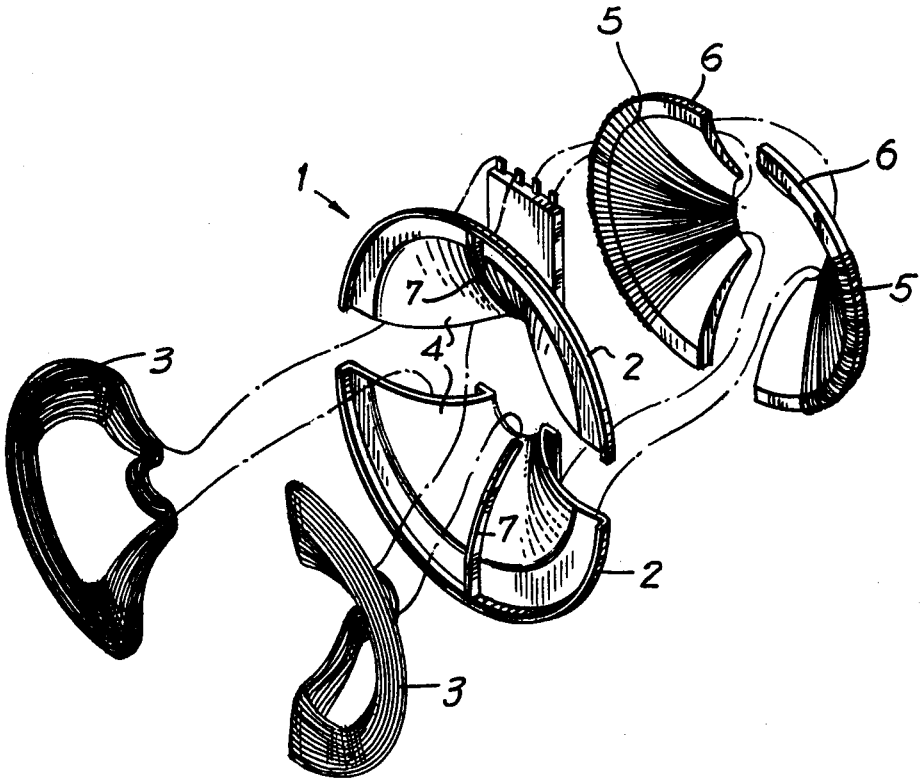
FIG. 1 PRIOR ART
FIG. 1 is an exploded perspective view showing a typical prior art deflection yoke.

It is thus seen that the deflection yoke of the present invention provides an orientation for separator halves, core halves, horizontal deflection coils and vertical deflection coils which have a mating surface along the same plane. This allows for ease of assembly of each half of the deflection yoke and also provides for proper orientation and retention of the respective coil members. Manufacture is made considerably easier than the manufacture of yokes of the prior art as exemplified by that shown in FIG. 1. In addition, the deflection yoke of the present invention provides greater ease of quality inspection of the yoke during the manufacturing process. Because of the manner of assembly, the saddle wound deflection coils are adequately supported during the assembly process so that misorientation of the coils is minimized due to possible mishandling of the coils during the assembly step.

What is claimed is:

1. A deflection yoke for use on a cathode ray tube comprising a pair of separator halves having a planar mating surface of engagement, each of said separator halves having interengaging means to join said halves together, a deflection coil mounted in each said separator half, means to support said deflection coil in each said separator half, said deflection coils being positioned within said deflection yoke such that the plane of separation between said coils is coincident with the planar mating surface of engagement of said separator halves.

2. A deflection yoke according to claim 1 wherein said deflection coils mounted in each said separator half are saddle wound horizontal deflection coils and including a pair of toroidal wound deflection coils each wound about a core half, said vertical deflection coils being positioned about said separator and having the plane of separation between said vertical deflection coils coincident with the plane of separation of said horizontal deflection coils and the planar mating surface of said separator halves.

3. A deflection yoke for use on a cathode ray tube comprising a pair of identical separator halves joined together in a planar mating surface of engagement, each said separator half comprising a front portion, a rear portion and a gradually widening segment interconnecting said front and rear portions, said front and rear portions including outwardly facing flat bearing surfaces to receive and support the bending portion of a saddle wound deflection coil supported within said separator half and means on each said separator half to locate and support said deflection coil.

4. A deflection yoke according to claim 3 wherein said means to locate and support said deflection coil includes a flange portion about the periphery of said front portion bearing surface, resilient members disposed in said flange portion to resiliently abut against a bent portion of said deflection coil and resilient retaining members formed adjacent the mating surface of said interconnecting segment to restrain a mid segment of said deflection coil.

5. A deflection yoke according to claim 3 wherein each said separator half includes coupling means adjacent its mating surface for interlocking engagement with a mating separator half comprising an extending locating pin and locking projection having an enlarged end adapted to mate with a complimentary receiving bore and projection receiving opening when said pair of separator halves are joined together, said locking projection extending through said projection receiving opening with said enlarged head bearing against the surface defining the opening to securely lock said separator halves together.

6. A deflection yoke according to claim 3 including a pair of vertical deflection coils each wound about a core half, said core halves positioned about said separator with the plane of separation of said horizontal and vertical deflection coils and said separator and core halves being coincident.

7. A deflection yoke according to claim 6 wherein each said separator half includes means to orient and retain said vertical deflection coil in its proper orientation.

8. A deflection yoke according to claim 7 wherein said means to orient and retain said vertical deflection coil comprises a bearing surface to support one side of said vertical deflection coil and resilient contacting means provided to contact the other side of said vertical deflection coil to resiliently urge and retain said vertical deflection coil on said separator half.

9. A deflection yoke according to claim 8 wherein said resilient contacting means comprise an integral spring projection formed within said separator half.

* * * * *